United States Patent [19]

Hoffman et al.

[11] Patent Number: 4,989,764

[45] Date of Patent: Feb. 5, 1991

[54] DISPOSABLE SEWING IMPLEMENT

[76] Inventors: Janice Hoffman; Fredrick M. Weintraub, both of 104 Grotke Rd., Chestnut Ridge, N.Y. 10972

[21] Appl. No.: 498,721

[22] Filed: Mar. 26, 1990

[51] Int. Cl.[5] ..... D05B 85/00; D05B 85/12

[52] U.S. Cl. ..... 223/102; 606/224

[58] Field of Search ..... 223/102; 112/222; 163/1; 606/224, 228, 226, 227, 139

[56] References Cited

U.S. PATENT DOCUMENTS

| | | | |
|---|---|---|---|
| 2,883,096 | 4/1959 | Dawson | 223/102 |
| 3,206,086 | 9/1965 | Duffney | 223/102 |
| 3,394,704 | 7/1968 | Dery | 223/102 |
| 3,534,740 | 9/1970 | Thompson | 223/102 |
| 3,910,282 | 10/1975 | Messer | 223/102 |
| 3,981,307 | 9/1976 | Borysko | 163/1 X |
| 4,671,437 | 6/1987 | Sauger | 223/102 |

*Primary Examiner*—Werner H. Schroeder
*Assistant Examiner*—Bibhu Mohanty
*Attorney, Agent, or Firm*—Iman Abdallah

[57] ABSTRACT

A sewing implement is provided comprising a metallic needle fixedly attached to a short length of fibrous thread wherein the needle and thread are attached by a film of plastic coating which extends over the entire length of the needle and a portion of the adjacently disposed end of said thread.

2 Claims, 1 Drawing Sheet

DISPOSABLE SEWING IMPLEMENT

BACKGROUND OF THE INVENTION

The present invention generally relates to implements for sewing. More particularly, the present invention relates to disposable sewing implements.

Threading a needle is a tedious task that often cannot be accomplished by the handicapped, elderly and those having difficulty in performing fine motor tasks or having poor vision. Furthermore, oftentimes a short length of thread is needed for quick mending of a button or small tear, for example, which demonstrates the need for a readily available and portable needle and thread.

A disposable sewing implement is disclosed in U.S. Pat. No. 2,883,096 to Dawson comprising a thermoplastic resin needle integrally merged with a length of flexible thermoplastic resin thread. The Dawson invention does not provide means for a needle combined with variously-colored fibrous thread material which is necessary for many sewing tasks wherein the thread will be revealed and continuity in appearance is desired. In U.S. Pat. No. 3,206,086 to Duffney a disposable threaded needle is disclosed wherein a plastic needle has a strand of thread embedded in its blunt end which communicates with a thread spool that is detachably secured to said needle. Like the sewing implement disclosed in the Dawson invention the Duffney threaded needle utilizes molded plastic material to form the needle portion of the device which eliminates some of the advantages of the steel or other metallic needles.

A primary consideration for the use of a plastic material for the sharp portion of a sewing implement is to prevent injury resulting from mislaid or misused sewing devices. This solution to the problem of potential injury however eliminates the handling advantages afforded by a needle formed from metals. Plastic needles must be formed with a slender diameter which does not have the rigidity of the convention steel needles and thus plastic needles often bend during use or must be constructed of a thickness unsuitable for many close tolerance uses. Therefore there remains a need in the prior art for a safe disposable sewing implement having the rigid qualities of the conventional needle.

SUMMARY OF THE INVENTION

The disposable sewing implement of the present invention provides a metallic needle having a sharp pointed end and a blunt end, in combination with a length of fibrous thread disposed in axial abutment at the blunt end of the needle, the needle and thread being attached by a film of plastic coating which covers the entire length of the needle and a short portion of the thread disposed adjacent to the blunt end of the needle.

An object of the present invention is to provide a disposable sewing implement which combines a metallic needle and fibrous thread in a single unit.

Another object of this invention is to provide a sewing implement adaptable for use with various colored threads.

It is also an object of this invention to provide a sewing implement that utilizes a metallic needle having a protected sharp end.

A still further object of the present invention is to provide a sewing implement of simple construction requiring no boring or slitting of the needle portion.

These and other objects and advantages of the sewing implement of the present disclosure will be apparent to those skilled in the art from the following description of a preferred embodiment, claims, and accompanying drawings.

DESCRIPTION OF A PREFERRED EMBODIMENT

Figure 1:
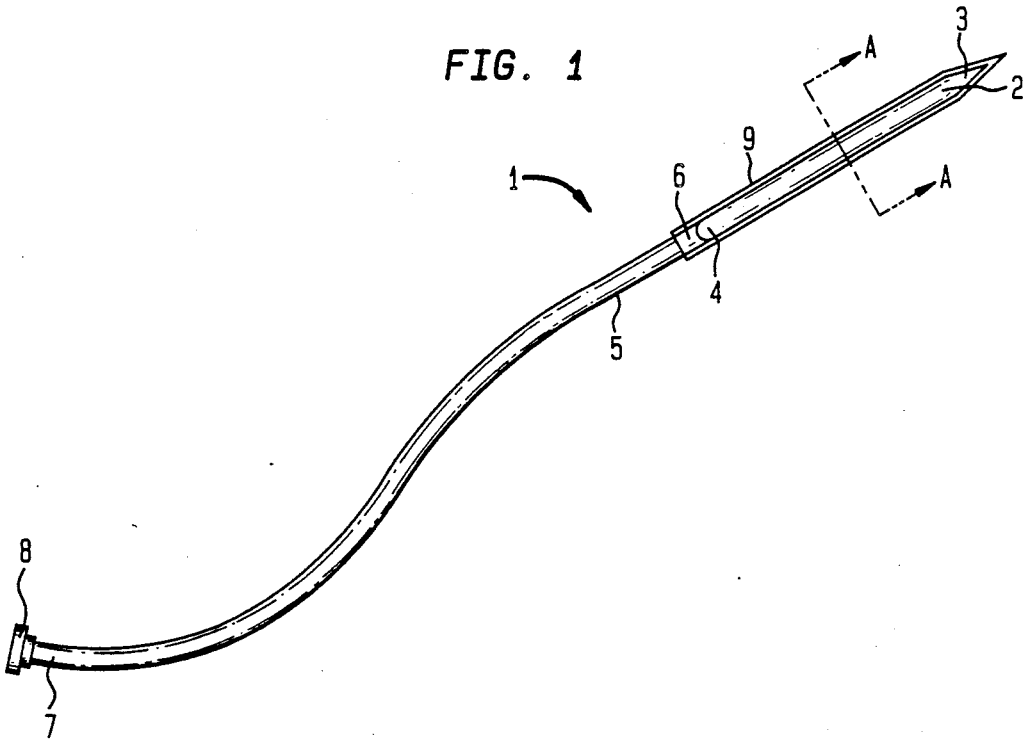
FIG. 1 is an enlarged side perspective view of the present invention.
Figure 2:
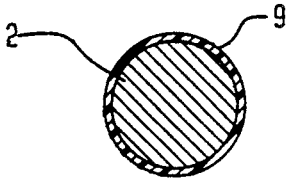
FIG. 2 is a cross-sectional view taken along line A—A of FIG. 1.

FIG. 1 illustrates in an enlarged perspective view the disposable sewing implement 1 of the present invention. Sewing implement 1 includes a metallic needle 2 having a sharp pointed end 3 and an opposite blunt end 4, and a short length of fibrous thread 5 having a first end 6 abutted adjacently to the blunt end 4 of said needle 2. A flat bead of plastic 8 is integrally attached to the distal end 7 of said thread 5. The flat shape of the bead of plastic 8 permits the end of the fibrous thread 5 to be drawn in close proximity to a garment that is to be mended thereby permitting a smooth undersurface not attainable by the use of a thread having a knotted end. A film of plastic coating 9 covers the entire length of said needle 2 and extends for a short length about the abutting first end 6 of said thread 5. As can be seen in FIG. 2 the film of plastic coating 9 extends about the periphery of said needle 2 on all sides. Coating 9 likewise extends on all sides of the proximate portion of said thread 5. The film of plastic coating 9 provides means for fixedly attachment of said needle 2 and said fibrous thread 5.

Utilizing the construction of the present disclosure sewing implements can be provided having variously-colored threads which is particularly important when the threads are visible upon completion of the mending task. The provision of a plastic coated metallic needle maintains the rigid composition of metal while preventing injury from the sharp pointed end of the needle.

Therefore, in view of the foregoing,

I claim:

1. A sewing implement comprising a metallic needle having a sharp pointed end and a blunt end, and a length of fibrous material abutting the blunt end of said needle in its entirety, said needle and the end of said fibrous material disposed adjacently to said needle being coated by a film of plastic, said needle and said fibrous material being held in fixedly attachment by said film of plastic.

2. A sewing implement as described in claim 1 wherein a flat bead of plastic is fixedly attached to the distal end of said length of fibrous material.

* * * * *